US009127521B2

(12) United States Patent
Hall et al.

(10) Patent No.: US 9,127,521 B2
(45) Date of Patent: Sep. 8, 2015

(54) DOWNHOLE TOOL ACTUATION HAVING A SEAT WITH A FLUID BY-PASS

(75) Inventors: David R. Hall, Provo, UT (US); Scott Dahlgren, Alpine, UT (US)

(73) Assignee: Schlumberger Technology Corporation, Houston, TX (US)

( * ) Notice: Subject to any disclaimer, the term of this patent is extended or adjusted under 35 U.S.C. 154(b) by 1107 days.

(21) Appl. No.: 12/511,209

(22) Filed: Jul. 29, 2009

(65) Prior Publication Data

US 2010/0212886 A1 Aug. 26, 2010

Related U.S. Application Data

(63) Continuation of application No. 12/511,185, filed on Jul. 29, 2009, which is a continuation-in-part of application No. 12/424,853, filed on Apr. 16, 2009, now Pat. No. 7,669,663, and a continuation-in-part of application No. 12/391,358, filed on Feb. 24, 2009, now Pat. No. 8,365,843.

(51) Int. Cl.

| | |
|---|---|
| ***E21B 23/04*** | (2006.01) |
| ***E21B 23/00*** | (2006.01) |
| ***E21B 41/00*** | (2006.01) |
| *E21B 10/32* | (2006.01) |

(52) U.S. Cl.

CPC ..... *E21B 23/04* (2013.01); *E21B 23/004* (2013.01); *E21B 41/00* (2013.01); *E21B 10/32* (2013.01)

(58) Field of Classification Search

CPC ..... E21B 23/004; E21B 23/006; E21B 10/32; E21B 10/322; E21B 41/00; E21B 23/04; E21B 10/26; E21B 10/327; E21B 10/325; E21B 10/32

USPC ..... 166/378, 381, 237; 175/271, 268, 267, 175/263, 286

See application file for complete search history.

(56) References Cited

U.S. PATENT DOCUMENTS

| | | | |
|---|---|---|---|
| 1,258,418 | A | 3/1918 | Kemble |
| 1,712,948 | A | 5/1929 | Burch |
| 1,921,135 | A | 8/1933 | Santiago |
| 2,153,034 | A | 4/1939 | Baker |
| 2,170,452 | A | 8/1939 | Grant |
| 2,196,657 | A | 4/1940 | Burt |
| 2,320,670 | A | 6/1943 | Scaramucci |
| 2,427,052 | A | 9/1947 | Grant |
| 2,615,519 | A | 10/1952 | Carr |
| 2,737,244 | A | 3/1956 | Baker |
| 3,001,584 | A | 9/1961 | Scott |
| 3,039,531 | A | 6/1962 | Scott |
| 3,054,415 | A | 9/1962 | Baker et al. |
| 3,126,065 | A | 3/1964 | Chadderdon |
| 3,130,783 | A | 4/1964 | Orr |

(Continued)

*Primary Examiner* — Elizabeth Gitlin

(74) *Attorney, Agent, or Firm* — John C. Bacoch; Craig Buschmann; Brinks Gilson & Lione

(57) ABSTRACT

A downhole tool actuation system has a fluid path defined by a bore formed within a tubular body of a tool. A reciprocating sleeve is located within the bore and the sleeve has a segmented seat with a fluid by-pass. At least one seat segment is positioned by an outer diameter of the sleeve to complete the seat, and a relief is formed in a wall adjacent the outer diameter of the sleeve. When the seat is occupied by an obstruction, only a portion of the fluid path is obstructed and fluid impinging the obstruction causes the sleeve to move in the direction of flow until the at least one segment is relieved by the relief thereby releasing the obstruction.

20 Claims, 11 Drawing Sheets

(56) References Cited

U.S. PATENT DOCUMENTS

| | | | | | |
|---|---|---|---|---|---|
| 3,403,729 | A | | 10/1968 | Hickey | |
| 3,494,419 | A | * | 2/1970 | Mullins | 166/152 |
| 3,703,104 | A | | 11/1972 | Tamplen | |
| 3,758,731 | A | | 9/1973 | Vann et al. | |
| 3,823,773 | A | | 7/1974 | Nutter | |
| 3,986,554 | A | | 10/1976 | Nutter | |
| 4,007,797 | A | | 2/1977 | Jeter | |
| 4,033,408 | A | | 7/1977 | Fredd | |
| 4,081,042 | A | | 3/1978 | Johnson | |
| 4,132,243 | A | | 1/1979 | Kuus | |
| 4,266,605 | A | | 5/1981 | LaBorde | |
| 4,491,187 | A | | 1/1985 | Russell | |
| 4,520,870 | A | | 6/1985 | Pringle | |
| 4,574,894 | A | | 3/1986 | Jadwin | |
| 4,596,293 | A | | 6/1986 | Wallussek et al. | |
| 4,655,289 | A | | 4/1987 | Schoeffler | |
| 4,714,116 | A | | 12/1987 | Brunner | |
| 4,718,494 | A | * | 1/1988 | Meek | 166/373 |
| 4,782,894 | A | | 11/1988 | LaFleur | |
| 4,828,037 | A | | 5/1989 | Lindsey et al. | |
| 4,862,966 | A | | 9/1989 | Lindsey et al. | |
| 4,869,100 | A | | 9/1989 | Birdwell | |
| 4,889,199 | A | | 12/1989 | Lee | |
| 4,893,678 | A | | 1/1990 | Stokley et al. | |
| 4,895,214 | A | | 1/1990 | Schoeffler | |
| 4,915,172 | A | | 4/1990 | Donovan et al. | |
| 4,928,520 | A | | 5/1990 | Barrington | |
| 5,038,860 | A | | 8/1991 | Baugh et al. | |
| 5,117,927 | A | | 6/1992 | Askew | |
| 5,189,645 | A | * | 2/1993 | Innes | 367/84 |
| 5,230,390 | A | | 7/1993 | Zastresek | |
| 5,316,094 | A | | 5/1994 | Pringle | |
| 5,392,862 | A | | 2/1995 | Swearingen | |
| 5,450,914 | A | * | 9/1995 | Coram | 175/73 |
| 5,499,687 | A | | 3/1996 | Lee | |
| 5,553,678 | A | | 9/1996 | Barr | |
| 5,584,342 | A | * | 12/1996 | Swinford | 166/301 |
| 5,609,178 | A | | 3/1997 | Hennig | |
| 5,673,763 | A | | 10/1997 | Thorp | |
| 5,685,379 | A | | 11/1997 | Barr | |
| 5,695,015 | A | | 12/1997 | Barr | |
| 5,706,905 | A | | 1/1998 | Barr | |
| 5,730,222 | A | | 3/1998 | Rike | |
| 5,803,185 | A | | 9/1998 | Barr | |
| 5,833,002 | A | | 11/1998 | Holcombe | |
| 5,856,790 | A | | 1/1999 | Baugh et al. | |
| 6,089,332 | A | | 7/2000 | Barr | |
| 6,142,250 | A | | 11/2000 | Griffin | |
| 6,382,330 | B2 | | 5/2002 | Bischel et al. | |
| 6,390,200 | B1 | | 5/2002 | Allamon | |
| 6,419,014 | B1 | | 7/2002 | Meek et al. | |
| 6,431,270 | B1 | | 8/2002 | Angle | |
| 6,481,495 | B1 | | 11/2002 | Evans | |
| 6,561,289 | B2 | | 5/2003 | Portman et al. | |
| 6,571,888 | B2 | | 6/2003 | Comeau et al. | |
| 6,619,388 | B2 | | 9/2003 | Dietz et al. | |
| 6,634,428 | B2 | | 10/2003 | Krauss et al. | |
| 6,717,283 | B2 | | 4/2004 | Skinner | |
| 6,732,817 | B2 | | 5/2004 | Dewey | |
| 6,776,240 | B2 | | 8/2004 | Kenison | |
| 6,854,953 | B2 | | 2/2005 | Van Drentham-Susman | |
| 6,880,636 | B2 | | 4/2005 | Rogers et al. | |
| 6,920,930 | B2 | | 7/2005 | Allamon | |
| 7,036,611 | B2 | | 5/2006 | Radford | |
| 7,048,078 | B2 | | 5/2006 | Dewey | |
| 7,168,493 | B2 | * | 1/2007 | Eddison | 166/334.4 |
| 7,219,747 | B2 | | 5/2007 | Gleitman et al. | |
| 7,261,184 | B2 | | 8/2007 | Bass et al. | |
| 7,308,937 | B2 | | 12/2007 | Radford | |
| 7,331,397 | B1 | | 2/2008 | Wagley | |
| 7,637,323 | B2 | | 12/2009 | Schasteen et al. | |
| 8,356,670 | B2 | | 1/2013 | Telfer | |
| 8,662,162 | B2 | | 3/2014 | Kellner et al. | |
| 2002/0162661 | A1 | | 11/2002 | Krauss et al. | |
| 2004/0256153 | A1 | | 12/2004 | Helms et al. | |
| 2005/0145417 | A1 | | 7/2005 | Radford | |
| 2006/0034154 | A1 | | 2/2006 | Perry et al. | |
| 2006/0243455 | A1 | | 11/2006 | Telfer et al. | |
| 2007/0017679 | A1 | | 1/2007 | Wolf et al. | |
| 2007/0056724 | A1 | | 3/2007 | Spring et al. | |
| 2007/0062706 | A1 | | 3/2007 | Leising | |
| 2007/0107944 | A1 | | 5/2007 | Lee | |
| 2007/0242565 | A1 | | 10/2007 | Hall et al. | |
| 2007/0251696 | A1 | * | 11/2007 | Parks | 166/373 |
| 2007/0295514 | A1 | * | 12/2007 | Rohde et al. | 166/386 |
| 2008/0041597 | A1 | | 2/2008 | Fisher et al. | |
| 2008/0105464 | A1 | | 5/2008 | Radford | |
| 2008/0217024 | A1 | | 9/2008 | Moore | |
| 2008/0296015 | A1 | | 12/2008 | Hall et al. | |
| 2009/0044951 | A1 | | 2/2009 | Milkovisch et al. | |
| 2009/0056497 | A1 | | 3/2009 | Swinford | |
| 2009/0084555 | A1 | | 4/2009 | Lee | |
| 2009/0126936 | A1 | * | 5/2009 | Begley et al. | 166/319 |
| 2009/0166086 | A1 | | 7/2009 | Sugiura | |
| 2009/0308588 | A1 | * | 12/2009 | Howell et al. | 166/66.4 |
| 2010/0065125 | A1 | * | 3/2010 | Telfer | 137/1 |
| 2010/0132954 | A1 | * | 6/2010 | Telfer | 166/373 |
| 2011/0278017 | A1 | | 11/2011 | Themig et al. | |
| 2011/0315389 | A1 | * | 12/2011 | Crider et al. | 166/329 |

* cited by examiner

DOWNHOLE TOOL ACTUATION HAVING A SEAT WITH A FLUID BY-PASS

CROSS REFERENCE TO RELATED APPLICATIONS

This application is a continuation of U.S. patent application Ser. No. 12/511,185 filed on Jul. 29, 2009, which is a continuation-in-part of U.S. patent application Ser. No. 12/424,853 filed on Apr. 16, 2009 and which is now U.S. Pat. No. 7,669,663 issued on Mar. 2, 2010. U.S. patent application Ser. No. 12/511,185 is also a continuation-in-part of U.S. patent application Ser. No. 12/391,358 filed on Feb. 24, 2009. Both of which are herein incorporated by reference for all that they disclose.

BACKGROUND

This invention relates to actuation mechanisms for tools in a downhole environment, such as reamers. Various efforts to provide reliable mechanical actuation of downhole tools are disclosed in the prior art.

U.S. Pat. No. 4,893,678 to Stokley et al. discloses a downhole tool suitable for multiple setting and unsetting operations in a well bore during a single trip. The downhole tool is suspended in the wellbore from a tubing string, and is activated by dropping a metal ball which plugs the passageway through the tubing string, such that tubing pressure may thereafter be increased to activate the downhole tool. A sleeve is axially movable within a control sub from a ball stop position to a ball release position, and has a cylindrical-shaped interior surface with a diameter only slightly greater than the ball. Collet fingers carried on the sleeve are radially movable from an inward position to an outward position to stop or release the ball as a function of the axial position of the sleeve. Fluid flow through the tubing string is thus effectively blocked when the sleeve is in the ball stop position because of the close tolerance between the sleeve and the ball, while the ball is freely released from the sleeve and through the downhole tool when the sleeve is moved to the ball release position.

U.S. Pat. No. 4,889,199 to Lee discloses a downhole drilling device utilizing a spring-loaded sleeve within the casing for controlling circulation of fluid material. A plastic, i.e., deformable ball is used to block a flow opening in the sleeve for positioning the sleeve and aligning flow ports. Subsequently, the ball is deformed and the drilling operation continues. In one form, an expandable packer may be operated to close off the annulus about the casing.

U.S. Pat. No. 7,416,029 to Telfer discloses a downhole tool which can perform a task in a well bore, such as circulating fluid radially from the tool. The function is selectively performed by virtue of a sleeve moving within a central bore of the tool. Movement of the sleeve is effected by dropping a ball through a ball seat on the sleeve. Movement of the sleeve is controlled by an index sleeve such that the tool can be cycled back to the first operating position by dropping identical balls through the sleeve. Embodiments are described wherein the balls are deformable, the seat is deformable and the seat provides a helical channel through which the ball passes.

U.S. Pat. No. 3,703,104 to Tamplen discloses a positioning apparatus for effecting movement of a first body with respect to a second body in response to movement of a third body characterized by a slot traversal member engaging a set of driving slots and a set of driven slots that are formed respectively in the first and second bodies. One of the sets of driven and driving slots comprises a closed pattern of slots; and the other comprises a single slot having at least two portions that have the same design and are movable so as to be coextensive with the slots of the closed pattern of slots. Also disclosed are tubular and planar constructions employing the driving and driven slots.

BRIEF SUMMARY

In one aspect of the present invention, a downhole tool comprises a fluid path defined by a bore formed within a tubular body of the tool, a reciprocating sleeve located within the bore, the sleeve comprising a segmented seat or a seat with a moveable portion. The seat also comprises a fluid by-pass. The at least one seat segment or moveable portion is positioned by an outer diameter of the sleeve to complete the seat, and a relief formed in a wall adjacent the outer diameter of the sleeve, wherein when the seat is occupied by an obstruction only a portion of the fluid path is obstructed and fluid impinging the obstruction causes the sleeve to move in the direction of flow until the at least one segment is relieved by the relief and releases the obstruction. The relief may be a diametrically increased inner diameter of the wall, slot, grove, recess, or combinations thereof.

The at least one seat segment or movable portion of the seat may comprise a sliding pin, a pivoting lever, a compliant portion, one or more fluid passageways, or combinations thereof. The at least one seat segment may comprise a biasing element such as a coil spring or torsion spring.

The obstruction may comprise a generally spherical ball.

The reciprocating sleeve may be biased in an axial direction opposite the direction of fluid flow by a biasing element such as a compression spring. The relief may comprise a diametrically widened space inside the tubular body of the tool. A tapered portion may be disposed intermediate the diametrically widened space and an inside diameter of the downhole tool. The relief may comprise a plurality of recesses in the tubular body of the tool.

The reciprocating sleeve may comprise a flange sealed to the bore of the tubular body. The reciprocating sleeve may comprise one or more fluid passages in communication with the fluid path before the obstruction and in communication with a volume partially defined by the bore of the tool and a posterior surface of the flange. The reciprocating sleeve may be lubricated by a fluid isolated from the fluid in the fluid path.

One or more pins may position the reciprocating sleeve at an initial position relative to the tubular body of the tool, and the pins shear upon actuation by a first obstruction. The downhole tool may actuate a reamer, winged reamer, probe, radially or axially extendable sensor, a generator, drill bit jack element, vibrator, jar, steering tool, mechanical or electrical switch, acoustic source, electric source, nuclear source, central tap, perforating gun, valve, telemetry device, or combinations thereof.

In another aspect of the present invention, a downhole tool comprises a fluid path defined by a bore formed within a tubular body of the tool, a reciprocating sleeve located within the bore, the sleeve comprising a segmented seat with a fluid by-pass; at least one seat segment is positioned by an outer diameter of the sleeve to complete the seat, and a relief formed in a wall adjacent the outer diameter of the sleeve, wherein when the seat is occupied by an obstruction only a portion of the fluid path is obstructed and a minority of the flow is arrested, but a pressure differential caused by the obstruction causes the sleeve to move in the direction of flow until the at least one segment is relieved by the relief and releases the obstruction.

In another aspect of the present invention, a downhole tool comprises a fluid path defined by a bore formed within a tubular body of the tool, a reciprocating sleeve and a guided sleeve located within the bore, the sleeves substantially coaxial with one another, the guided sleeve comprises at least one guide recess, the reciprocating sleeve comprises at least one guide protrusion engaged in the guide recess; wherein a reciprocating movement of the reciprocating sleeve causes the guide protrusion and guide recess to disengage and upon reengagement the geometry of the guide recess repositions the guided sleeve.

The reciprocating sleeve may comprise an extension intermediate the sleeve and the at least one guide protrusion. The at least one guide recess may be disposed on an outer diameter of the guided sleeve. The reciprocating sleeve may be disposed substantially exterior to the guided sleeve, and the at least one guide recess may comprise partially helical geometry. The at least one guide protrusion may be disposed on an inside diameter of the reciprocating sleeve.

The guided sleeve may comprise fluid ports in communication with the fluid path in the tubular body of the tool. The fluid ports may be in selectable communication with fluid passages in the tool body. The guided sleeve may comprise first and second indexed positions corresponding to fluid passages and ports in communication, and fluid passages and ports separated. The guided sleeve may comprise a plurality of indexed positions alternating between fluid passages and ports in communication and fluid passages and ports separated. The guided sleeve may be rotatable more than one full revolution. A function of the downhole tool may be activated at the first indexed position. The downhole tool may comprise a reamer.

The reciprocating sleeve and the guided sleeve may be lubricated by a fluid flowing in the fluid path. In other embodiments, the reciprocating sleeve and guided sleeve may be lubricated by a fluid separated from the fluid flowing in the fluid path.

Rolling bearings such as balls or rollers may be disposed on an outer diameter of the guided sleeve intermediate the outer diameter and the bore of the tubular body.

The reciprocating sleeve may be biased in a direction opposite the direction of a flow of fluid in the fluid path. The reciprocating sleeve may be actuated by an obstruction.

In some embodiments, the obstruction may comprise a hollow sleeve with a spherical ball releaseably engaged in the hollow sleeve, wherein the hollow sleeve substantially blocks the fluid ports from communication with the fluid path in the tubular body of the tool.

The guided sleeve may comprise pins that initially position the guided sleeve with respect to tubular body of the tool, wherein the pins shear upon actuation of the guided sleeve by a first obstruction.

DETAILED DESCRIPTION

Figure 1:
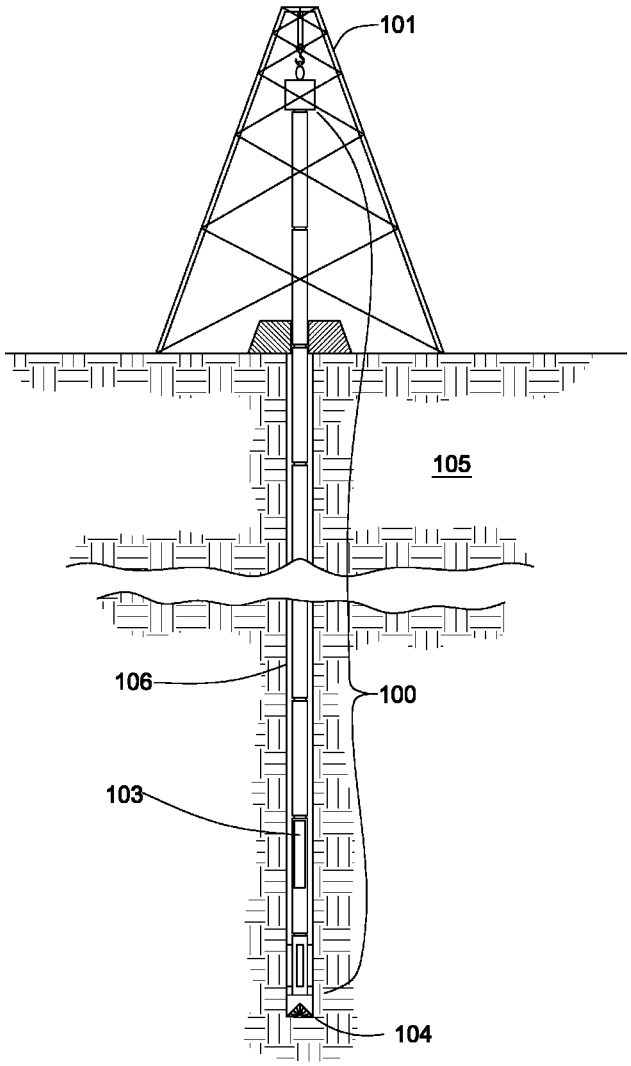
FIG. 1 is a cross-sectional view of an embodiment of a drillstring.

Referring now to the figures, FIG. 1 discloses an embodiment of a drilling operation. A drill string 100 is suspended by a derrick 101 and comprises a drill bit 104 and a downhole tool 103. In this embodiment, downhole tool 103 comprises a reamer for enlarging a bore 106 in a formation 105. It is desirable to selectively activate and deactivate the downhole tool 103 while the drill string 100 is in operation.

Figure 2:
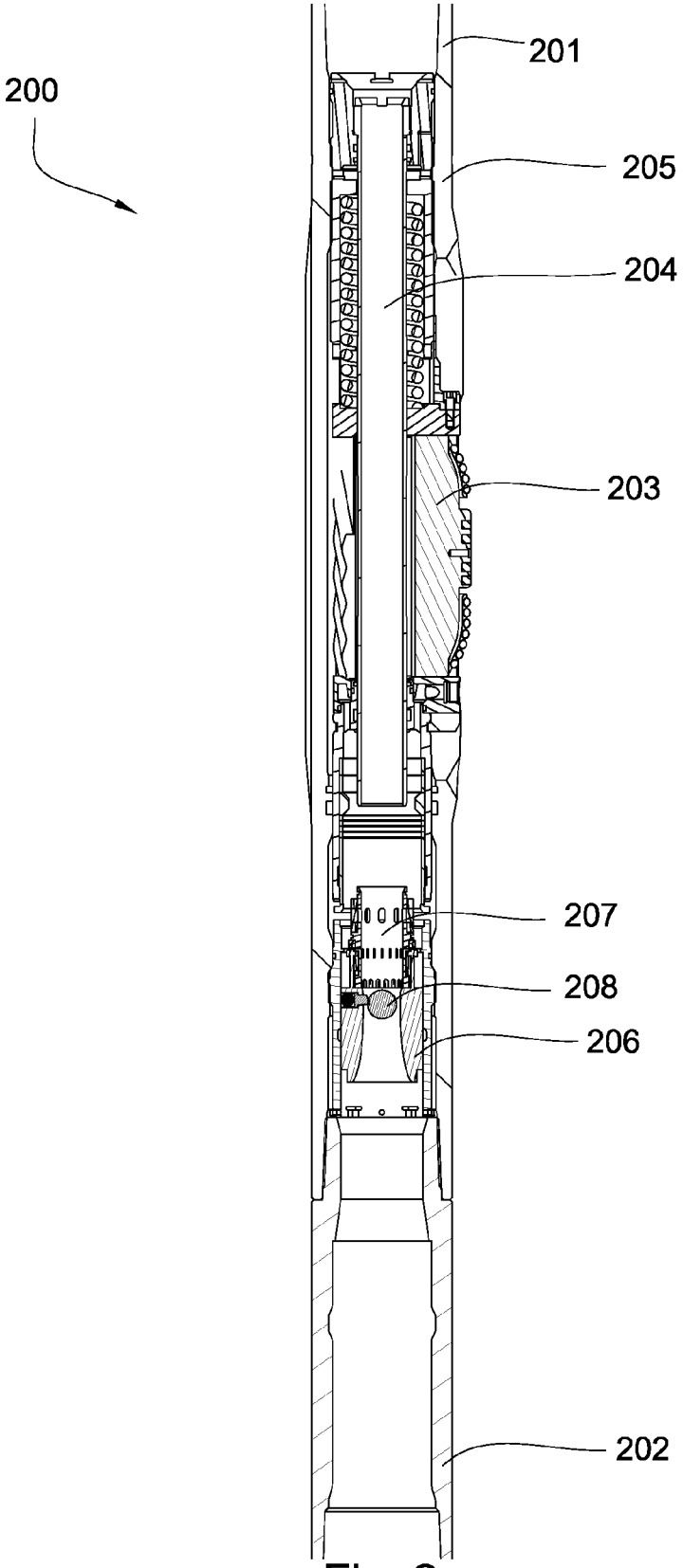
FIG. 2 is a cross-sectional view of an embodiment of a downhole tool.

FIG. 2 discloses an embodiment of a downhole tool 200 with a first end 201 and a second end 202. First end 201 connects to a portion of drill string that extends to the surface of a borehole, and second end 202 may connect to a bottom whole assembly or drill bit, measuring or logging while drilling system, or other downhole devices or drill string segments. Downhole tool 200 comprises a reamer 203, a fluid path 204 through a tool body 205, a reciprocating sleeve 206, a guided sleeve 207, and a droppable obstruction 208. Droppable obstruction 208 may be dropped from the surface during the drilling operation when activating or deactivating the downhole tool 200 is desired.

In the prior art, many ball drop tool actuation systems substantially block the flow of drilling fluid, thereby generating sufficient pressure in the drilling fluid to force the drop ball or obstruction through the actuation mechanism. Drilling fluid may provide cooling and lubrication for the drilling machinery, as well as chip removal from the bit face, bore sealing, and data transmission. Therefore, a tool actuation system that allows drilling fluid to continue to flow while activating or deactivating the tool is desirable.

Figure 3A:
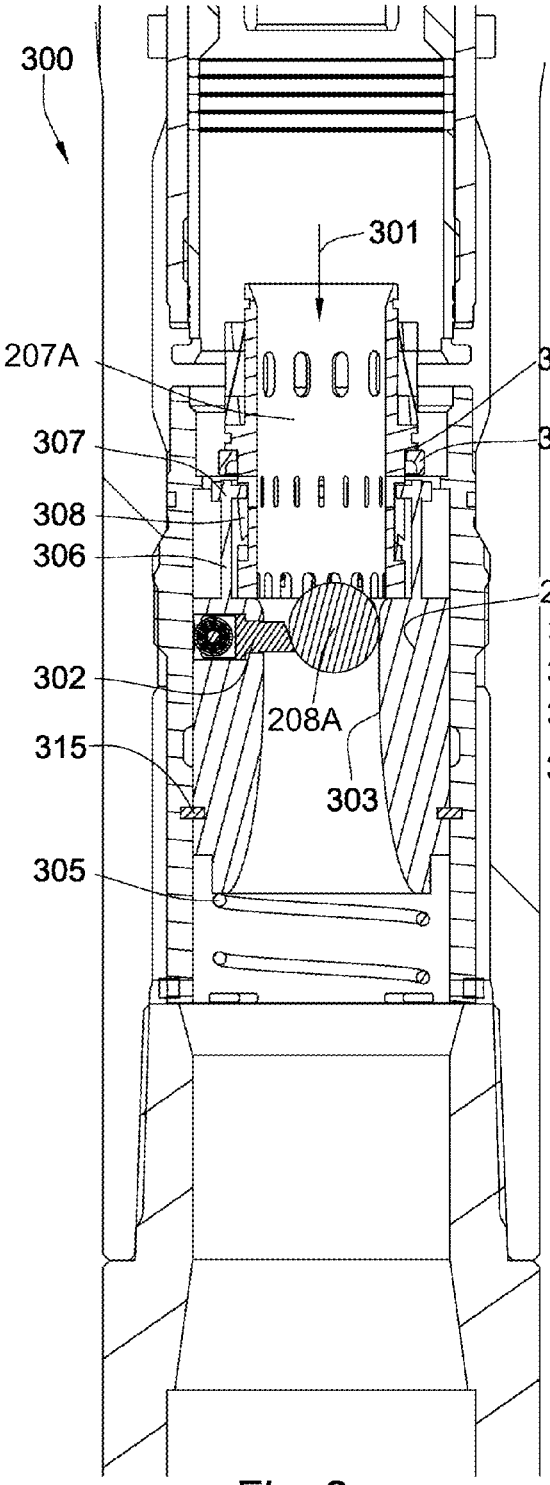
FIG. 3*a* is a cross-sectional view of another embodiment of a downhole tool.

FIG. 3*a* discloses an embodiment of a downhole tool 300 comprising a reciprocating sleeve 206A and a guided sleeve 207A. An obstruction 208A enters the reciprocating sleeve 206A along direction 301. The obstruction 208A contacts a seat segment 302 and is retained against a wall 303 of the reciprocating sleeve 206A and the seat segment 302. The wall 303 may include protrusions to retain the obstruction 208A away from the wall 303 and allow drilling fluid to flow. Drilling fluid flows in direction 301 and impinges on obstruction 208A, creating a pressure differential. Drilling fluid is substantially free to flow around the obstruction 208A, and a flow of the drilling fluid in the drilling assembly continues. The pressure differential forces the obstruction 208A together with the reciprocating sleeve 206A in direction 301 against the force of a biasing element 305. In this embodiment, the biasing element 305 comprises a compression type coil spring. The biasing element 305 may also comprise a plurality of coil springs, Bellville springs, or other spring elements.

The obstruction 208A may comprise a metal material such as steel or other another iron alloy, zinc or brass alloys, or other metals. The obstruction may be substantially spherical, may be elongated or dart shaped, or may have other appropriate geometry.

The reciprocating sleeve 206A comprises a cylindrical extension 306 and guide protrusions 307. The guide protrusions 307 engage in partially helical guide recesses 308 disposed in the guided sleeve 207A. As the reciprocating sleeve 206A moves in direction 301, the guide protrusions 307 slide in the partially helical guide recesses 308, rotating the guided sleeve 207A. The guided sleeve 207A comprises a flange 313 that bears against a retaining ring 314, preventing axial motion, but allowing rotation of the guided sleeve 207A. The guided sleeve 207A may have rolling bearings, such as needle or ball bearings, disposed intermediate, or between, guided sleeve 207A and a body of the downhole tool 300. In some embodiments, the bushings may be disposed intermediate the guided sleeve 207 and a body of the downhole tool 300. The bushings may comprise brass, bronze, Babbitt metal, or wear resistant materials such as polycrystalline diamond.

Shear pins 315 may locate the reciprocating sleeve 206A with respect to the body of the downhole tool 300.

Figure 3B:
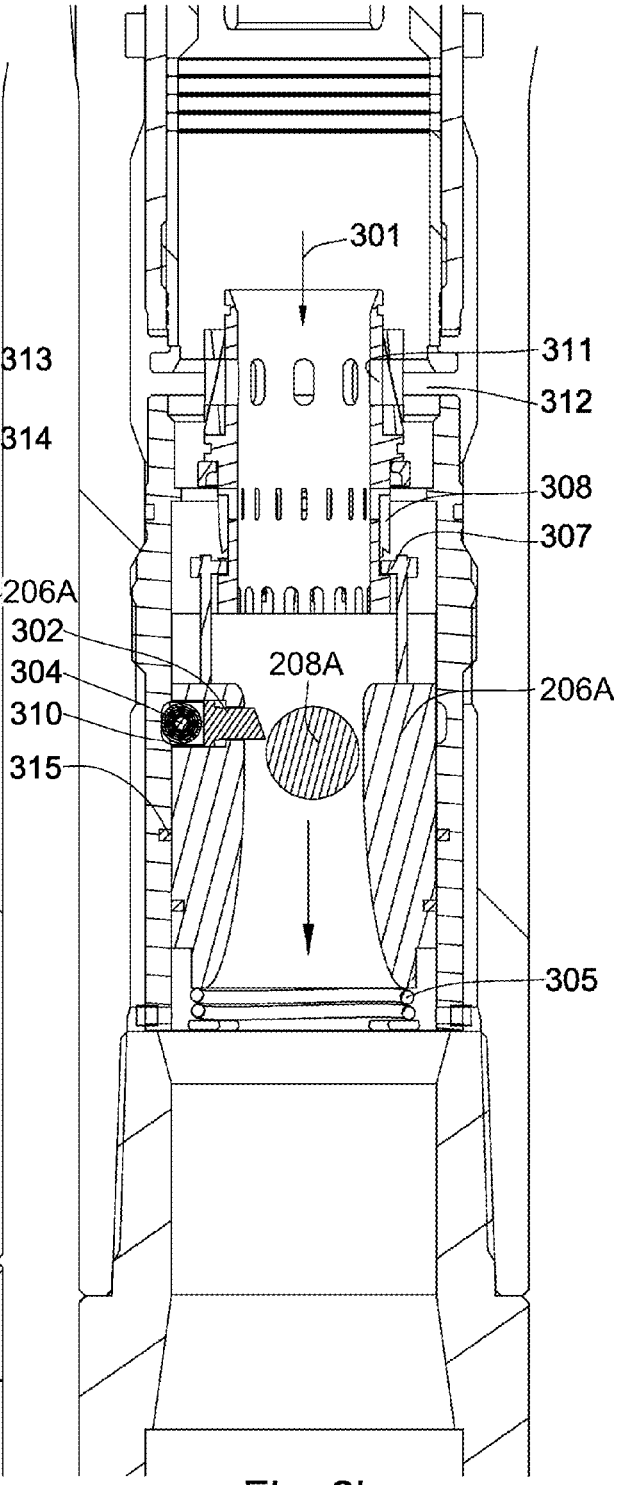
FIG. 3*b* is a cross-sectional view of another embodiment of a downhole tool.

In FIG. 3*b*, the reciprocating sleeve 206A is forced in direction 301 in response to the pressure differential generated by drilling fluid flowing in direction 301 against obstruction 208A. The shear pins 315 fail under the load, allowing the reciprocating sleeve 206A to move in direction 301 such that a roller 304 reaches a relief 310. The seat segment 302 is thus able to slide away from the obstruction 208A, allowing the obstruction 208A to pass through the reciprocating sleeve 206A, relieving the pressure differential. The seat segment 302 may comprise an element such as a coil spring or Bellville spring that biases the seat segment 302 to slide away from obstruction 208A when the roller 304 reaches the relief 310. After the obstruction 208A passes through the reciprocating sleeve 206A, the reciprocating sleeve biasing element 305 forces the reciprocating sleeve 206A back in a direction opposite direction 301. The guide protrusions 307 slide in the guide recesses 308 to further rotate the guided sleeve 207A, and ports 311 in the guided sleeve 207A align with fluid passages 312 enabling actuation of a downhole tool 300.

Each successive obstruction that passes through the reciprocating sleeve 206A alternates the guided sleeve 207A between positions in which the fluid ports 311 are in communication with the fluid passages 312 in the body of the downhole tool 300 and positions in which the fluid ports 311 and the fluid passages 312 are separated.

The guided sleeve 207A and the reciprocating sleeve 206A may be lubricated against the body of the downhole tool 300 by a fluid separated from the fluid that flows through a fluid path of the downhole tool 300, or may be lubricated by the drilling fluid flowing in the fluid path. The drilling fluid may pass through a self-cleaning filter before entering the guided sleeve 207A or the reciprocating sleeves 208A to reduce the solids content of the drilling fluid and prevent the guided sleeves 207A, reciprocating sleeves 208A and other mechanisms from packing with particulate material.

Figure 4A:
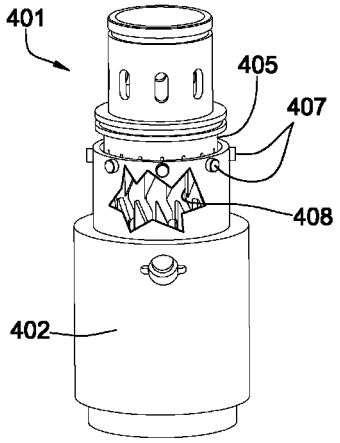
FIG. 4*a* is a perspective view of an embodiment of a guided sleeve and a reciprocating sleeve.
Figure 4B:
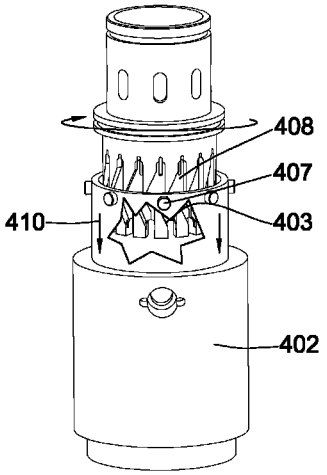
FIG. 4*b* is a perspective view of an embodiment of a guided sleeve and a reciprocating sleeve.
Figure 4C:
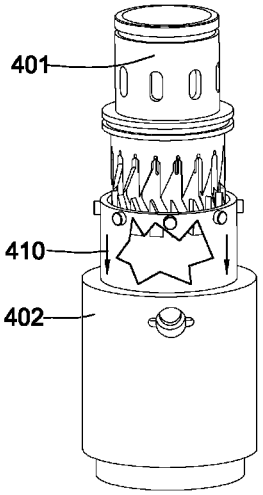
FIG. 4*c* is a perspective view of an embodiment of a guided sleeve and a reciprocating sleeve.
Figure 4D:
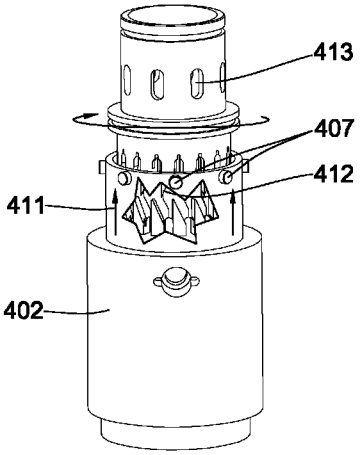
FIG. 4*d* is a perspective view of an embodiment of a guided sleeve and a reciprocating sleeve.

Referring now to FIG. 4*a*, an embodiment of a guided sleeve 401 and a reciprocating sleeve 402 is disclosed. Guide protrusions 407 engage guide recesses 408 disposed on an outside diameter 405 of the guided sleeve 401. In FIG. 4*b*, the reciprocating sleeve 402 moves in direction 410, and the guide protrusions 407 contact helical portions 403 of the guide recesses 408. As the guide protrusion 407 travels in direction 410 and bears against a lower helical portion 403, the guided sleeve 401 is forced to rotate. In FIG. 4*c*, the reciprocating sleeve 402 reaches a lowest position in direction 410 with respect to the guided sleeve 401. In FIG. 4*d*, the reciprocating sleeve 402 moves in direction 411, and the guide protrusions 407 bear against upper helical portions 412 of the guide recesses causing the guided sleeve 401 to rotate to a position in which ports 413 may align with fluid passages and activate a tool.

Figure 5:
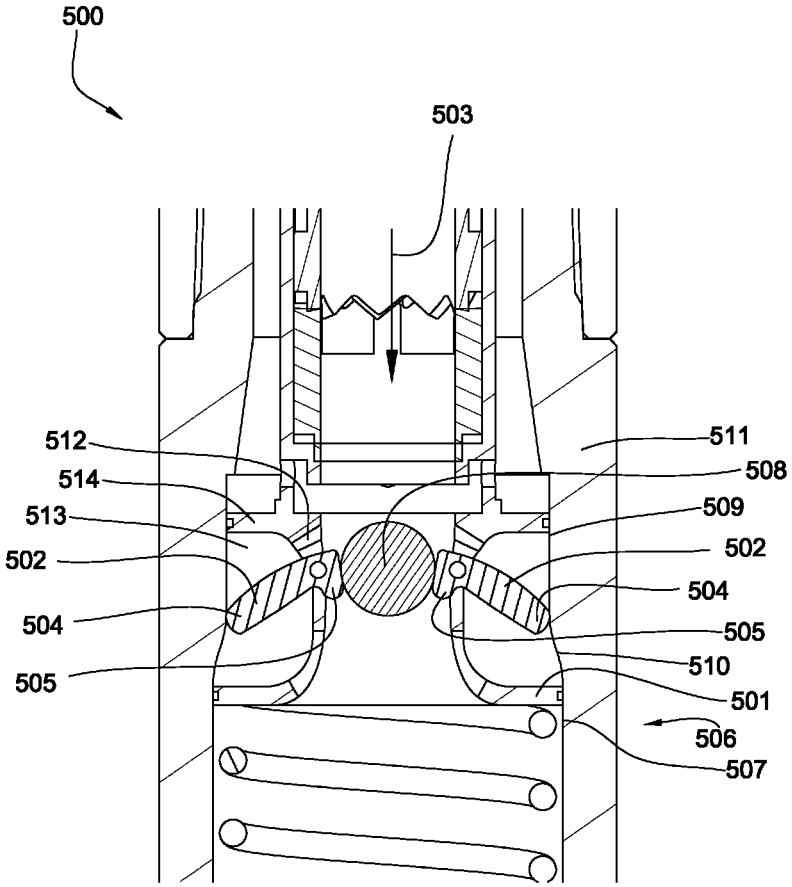
FIG. 5 is a cross-sectional view of another embodiment of a downhole tool.

FIG. 5 discloses another embodiment of a downhole tool 500. In this embodiment, a reciprocating sleeve 501 disposed within a tool body 511 comprises a plurality of pivoting levers 502 comprising a distal end 504 and a proximal end 505. The plurality of pivoting levers 502 retain an obstruction 508. Fluid flows in direction 503 and impinges obstruction 508, creating a pressure differential, thus causing the reciprocating sleeve 501 to move in direction 503 allowing the distal ends 504 of the plurality of pivoting levers 502 to enter a relieved portion 506. The pivoting levers 502 rotate, moving the proximate ends 505 apart thereby allowing the obstruction 508 to pass through the reciprocating sleeve 501. The pivoting levers 502 may be biased with torsion springs or coil springs.

The relieved portion 506 may comprise a diametrically widened space 507 with a tapered segment 510 intermediate, or between, the widened space 507 and an internal diameter 509 of the tool body 511. The relieved portion 506 may comprise polycrystalline diamond, hard facing, or other hard, abrasion resistant materials. Such wear resistant materials may also be applied to the distal ends 504 and the proximal ends 505 of the plurality of pivoting levers 502 to reduce wear and increase reliability.

The reciprocating sleeve 501 includes ports 512 in communication with the fluid flow upstream from the obstruction 508 and a volume 513 partially defined by a flange 514 of the reciprocating sleeve 501 and the tool body 511. The ports 512 may slow the movement of the reciprocating sleeve 501, and allow more time for a pressure build up, so pressure sensors may more easily sense the effects of actuating the tool.

Figure 6:
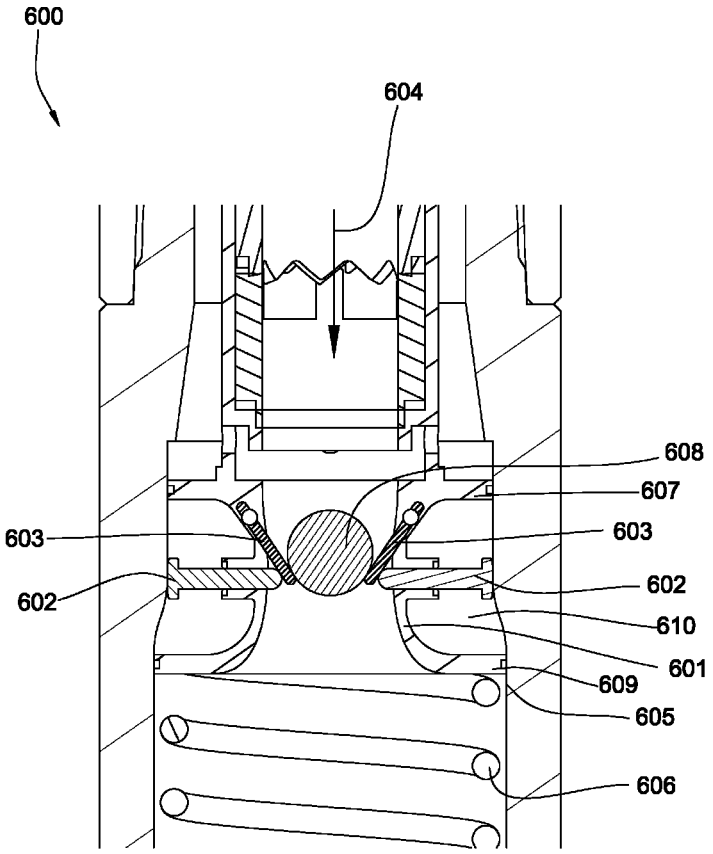
FIG. 6 is a cross-sectional view of another embodiment of a downhole tool.

FIG. 6 discloses a reciprocating sleeve 601 comprising one or more sliding pins 602 and one or more pivoting levers 603. A droppable obstruction 608 is retained by the pivoting levers 603 and the sliding pins 602. Fluid flows in direction 604 and impinges on the droppable obstruction 608 creating a pressure differential, causing the reciprocating sleeve 601 to move in direction 604. The sliding pins 602 are relieved by a relief 605 in a bore of the downhole tool 600, and the pins 602 and the levers 603 move to allow the droppable obstruction 608 to pass through the reciprocating sleeve 601. A biasing element 606 returns the reciprocating sleeve 601 to an initial position after the droppable obstruction 608 passes though. In this embodiment, the reciprocating sleeve 601 comprises a first flange 607 and a second flange 609. The first flange 607 and the second flange 609 positively locate the reciprocating sleeve 601 in the downhole tool 600, and may retain a lubricating fluid within space 610.

Figure 7:
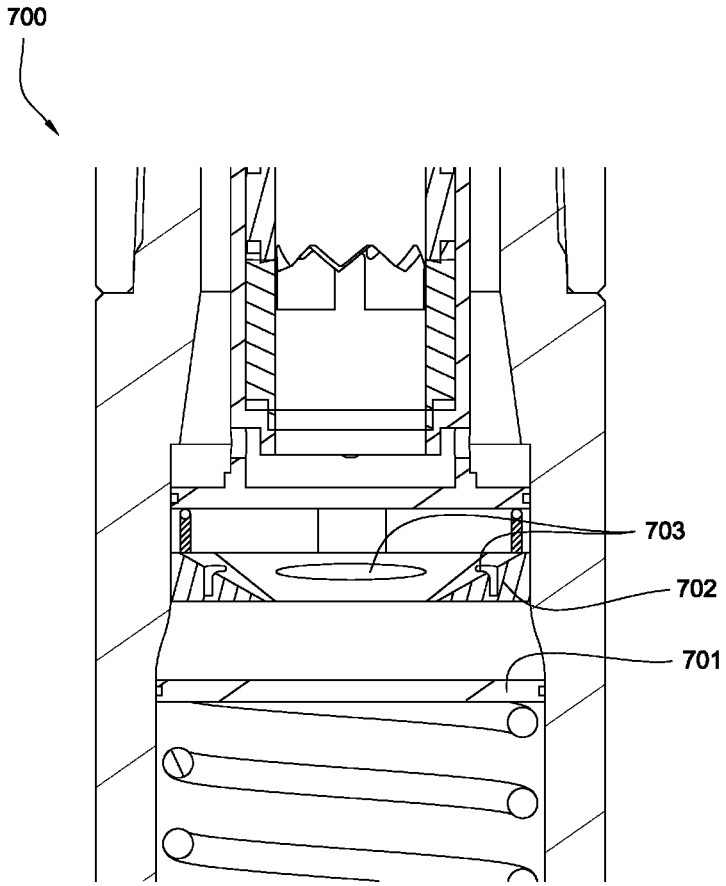
FIG. 7 is a cross-sectional view of another embodiment of a downhole tool.

FIG. 7 discloses another embodiment of a downhole tool 700. In this embodiment, the downhole tool 700 comprises a reciprocating sleeve 701 with a seat comprising a plurality of seat segments 702. The seat segments 702 comprise fluid passageways 703, allowing the flow of drilling fluid to continue while an obstruction occupies the seat.

Figure 8:
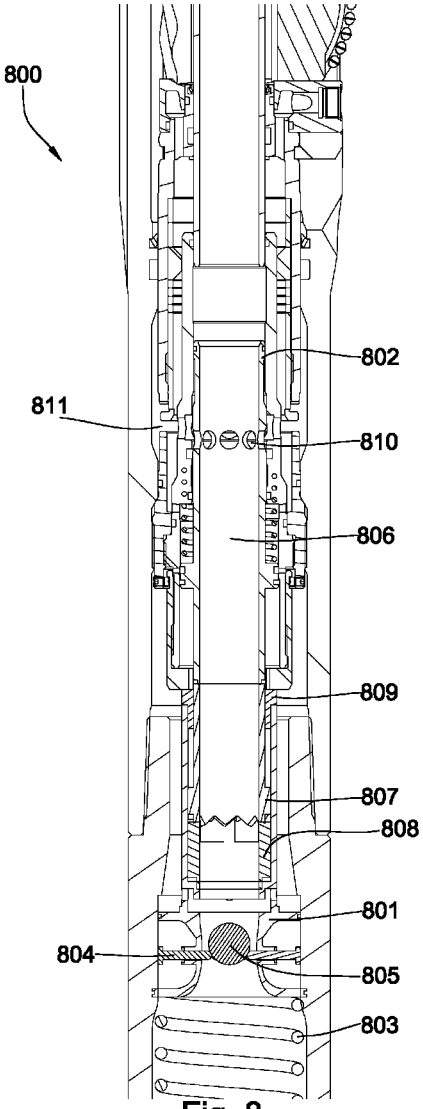
FIG. 8 is a cross-sectional view of another embodiment of a downhole tool.

FIG. 8 discloses a downhole tool 800 comprising a reciprocating sleeve 801 and a guided sleeve 802. The reciprocating sleeve 801 comprises a biasing element 803 and a plurality of sliding pins 804 that retain a droppable obstruction 805. A fluid path 806 is disposed inside the downhole tool 800. An indexing sleeve 807, an actuation sleeve 808, and a positioning sleeve 809 are disposed intermediate, or between, the reciprocating sleeve 801 and the guided sleeve 802. The guided sleeve 802 comprises fluid ports 810 in selectable communication with fluid passages 811. A downhole tool such as a reamer may be activated when the fluid ports 810 are in communication with the fluid passages 811 and deactivated when the fluid ports 810 are separated from the fluid passages 811.

Figure 9:
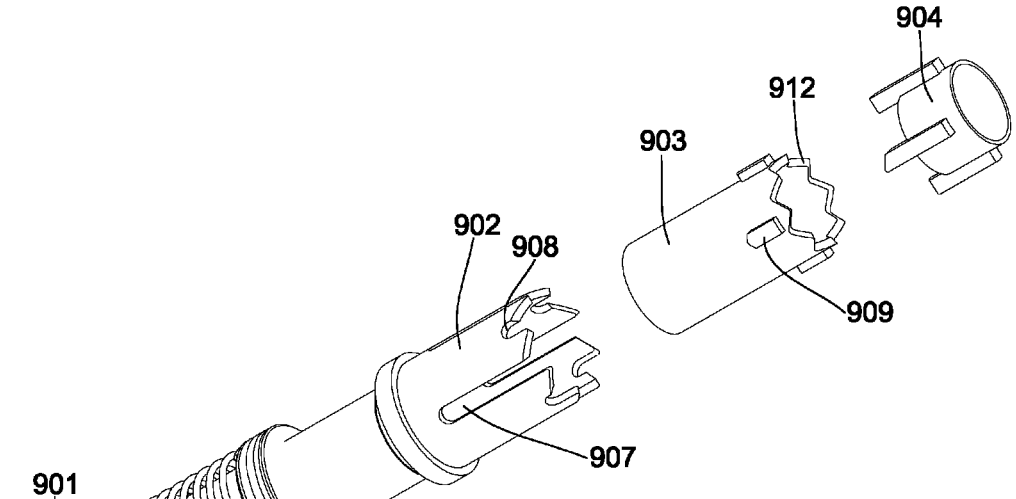
FIG. 9 is an exploded view of another embodiment of a guided sleeve.

FIG. 9 discloses a guided sleeve 901, an indexing sleeve 902, a positioning sleeve 903, and an actuation sleeve 904. The indexing sleeve 902 comprises first guide recesses 907 and second guide recesses 908, and the positioning sleeve 903 comprises guide protrusions 909 and a serrated crown 912. The guided sleeve 901 comprises fluid ports 910.

Figure 10:
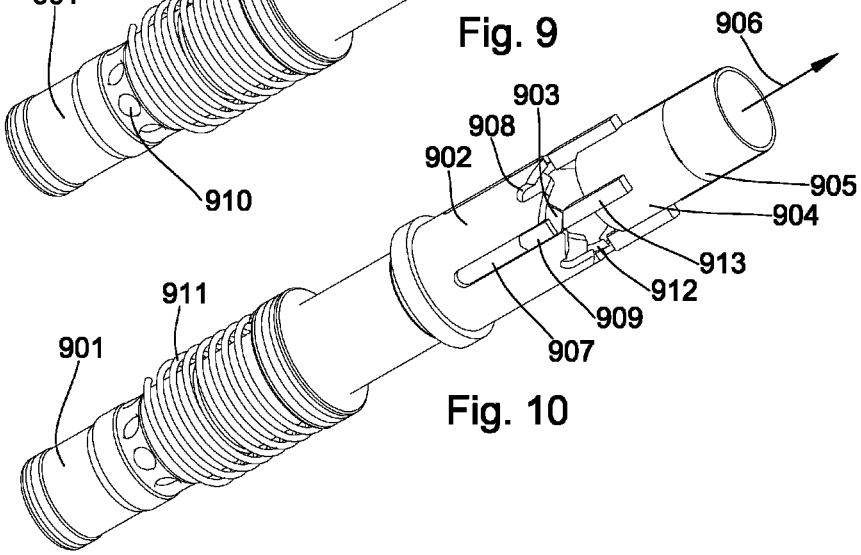
FIG. 10 is a perspective view of another embodiment of a guided sleeve.

In FIG. 10, the guided sleeve 901, the indexing sleeve 902, the positioning sleeve 903, and the actuation sleeve 904 are shown assembled. In use, the actuation sleeve 904 abuts a reciprocating sleeve 905, and the guided sleeve 901 abuts the positioning sleeve 903. When the reciprocating sleeve 905 moves in direction 906, the actuation sleeve 904 and the positioning sleeve 903 are kept in mechanical contact with the reciprocating sleeve 905 by a biasing spring 911. The indexing sleeve 902 remains stationary and the guide protrusion 909 leaves the first guide recess 907. The positioning sleeve 903 is rotated by contact between angled tabs 913 on the actuation sleeve 904 and the serrated crown 912. The guide protrusion 909 enters the second guide recess 908 as the reciprocating sleeve 905 returns to an original position. The first guide recesses 907 correspond to a first position of the positioning sleeve 903, and the second guide recesses 908 correspond to a second position of the positioning sleeve 903. The guided sleeve 901 remains in an axial position defined by the position of the positioning sleeve 903 until the reciprocating sleeve 905 undergoes a subsequent reciprocation and the guide protrusions 909 return to the first guide recess 907. Fluid ports 910 may be in communication with fluid passages in a tool body when the positioning sleeve 903 and the guided sleeve 901 are in the first position, and fluid ports 910 may be separated from fluid passages when the positioning sleeve 903 and the guided sleeve 901 are in the second position.

Figure 11:
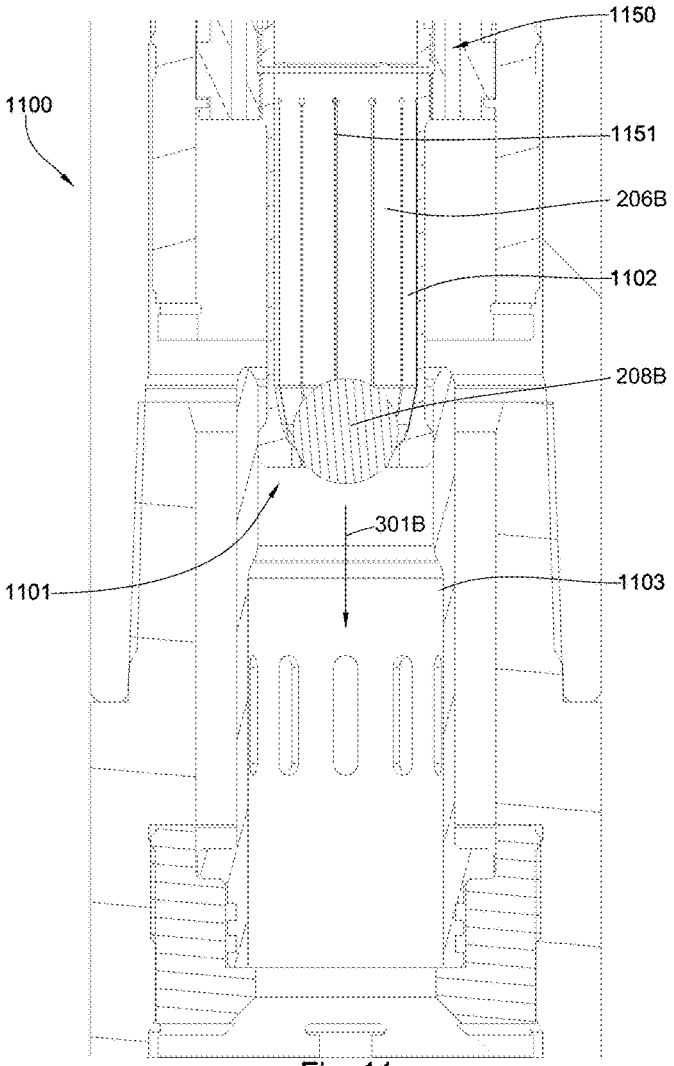
FIG. 11 is a cross-sectional view of another embodiment of a downhole tool.

FIG. 11 discloses another embodiment of a downhole tool 1100 comprising a reciprocating sleeve 206B with a segmented seat 1101. An obstruction 208B is retained by the segmented seat 1101, and a pressure differential in the drilling fluid caused by the obstruction 208B forces the obstruction 208B and the reciprocating sleeve 206B in direction 301. As the reciprocating sleeve 206B moves in direction 301B, the segmented seat 1101 reaches a diametric relief 1103, and compliant segments 1102 allow the segmented seat 1101 to expand, thereby allowing the obstruction 208B to pass through the segmented seat 1101 and relieving the pressure differential. Drilling fluid may pass through slots 1151 formed between the compliant segments 1102. The total slot area is large enough to allow sufficient amounts of drilling fluid to pass through to maintain the drilling fluid functions downstream while allowing enough of a pressure build-up to move the reciprocating sleeve 206B forward.

In some embodiments, pressure relief ports 1150 that relieve a portion of the pressure build-up may be incorporated within an affected area. The pressure relief ports 1150 are optimized to slow the pressure build-up so sensors may have more time to sense the pressure increase.

Figure 12A:
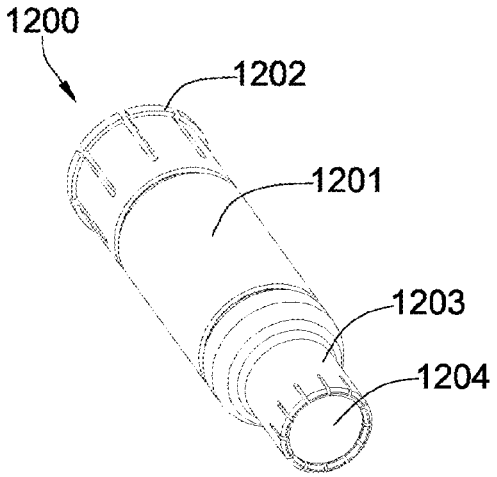
FIG. 12*a* is a perspective view of an embodiment of a dart.

FIG. 12*a* discloses an embodiment of a dart 1200. The dart 1200 comprises a hollow sleeve 1201 with a diametrically enlarged end 1202 opposite a smaller end 1203 having a reduced diameter. An obstruction 1204 is releaseably engaged in the smaller end 1203.

Figure 12B:
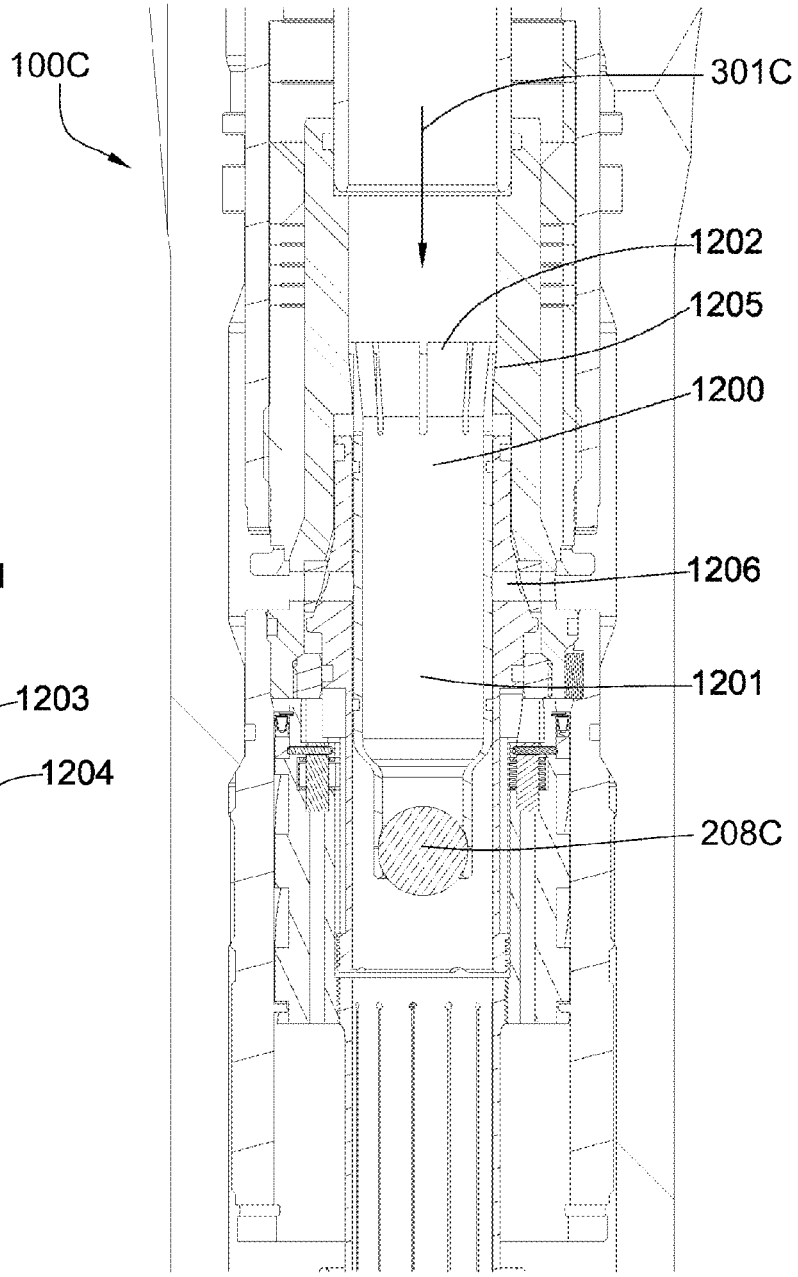
FIG. 12*b* is a perspective view of another embodiment of a downhole tool.

In FIG. 12*b*, the dart 1200 is lodged in a downhole tool 100C. The diametrically enlarged end 1202 abuts a shoulder 1205 in the downhole tool 100C, and the hollow sleeve 1201 blocks fluid ports 1206. Drilling fluid flowing in direction 301C creates a pressure differential and forces obstruction 1204 through the smaller end 1203 of hollow sleeve 1201.

It may be desirable to completely inactivate the downhole tool 100C, and by blocking the ports 1206 with the hollow sleeve 1201, the downhole tool 100C will not activate but will allow fluid flow to continue through the central bore of the downhole tool 100C and the drilling operation may continue.

Whereas the present invention has been described in particular relation to the drawings attached hereto, it should be understood that other and further modifications apart from those shown or suggested herein, may be made within the scope and spirit of the present invention.

What is claimed is:

1. A downhole tool comprising:

a tubular body having a bore formed therein and at least one fluid passage in a wall of the tubular body, the bore defining a fluid path;

a reciprocating sleeve configured to translate from a first location to a second location within the bore, the reciprocating sleeve having at least one guide protrusion; and a guided sleeve located within the bore, the guided sleeve being axially constrained, the guided sleeve having at least one guide recess and at least one port, the guide recess configured to receive the at least one guide protrusion and the guided sleeve being substantially coaxial with the reciprocating sleeve, wherein the at least one guide recess is configured to cause the guided sleeve to rotate in a first direction in response to the reciprocating sleeve being translated from the first location to the second location and cause the sleeve to rotate in the first direction in response to the reciprocating sleeve being translated from the second location to the first location, wherein the rotation of the guided sleeve causes the at least one port to align with the at least one fluid passage.

2. The downhole tool of claim 1, wherein the reciprocating sleeve includes an extension between the reciprocating sleeve and the at least one guide protrusion.

3. The downhole tool of claim 1, wherein the at least one guide recess is disposed on an outer surface of the guided sleeve.

4. The downhole tool of claim 1, wherein the reciprocating sleeve is disposed substantially about the guided sleeve.

5. The downhole tool of claim 1, wherein the guide recess comprises a partially helical geometry.

6. The downhole tool of claim 5, wherein the at least one guide protrusion is disposed on an inside surface of the reciprocating sleeve.

7. The downhole tool of claim 1, wherein the at least one port is in communication with the fluid path.

8. The downhole tool of claim 7, wherein the at least one port is in selectable fluid communication with the fluid passages in the tubular body.

9. The downhole tool of claim 8, wherein the guided sleeve has a first indexed position and a second indexed positions, the first indexed position corresponding to the at least one fluid passage and the at least one port being aligned and the second indexed position corresponding to the at least one fluid passage and the at least one port being unaligned.

10. The downhole tool of claim 9, wherein a function of the downhole tool is activated at the first indexed position.

11. The downhole tool of claim 8, wherein the guided sleeve has a plurality of indexed positions alternating between the at least one fluid passage and the at least one port being aligned and the at least one fluid passage and the at least one port being unaligned.

12. The downhole tool of claim 7, wherein an obstruction comprises a hollow sleeve with a spherical ball releasably engaged in the hollow sleeve and the hollow sleeve substantially blocks the fluid ports from communication with the fluid path in the tubular body of the tool.

13. The downhole tool of claim 1, wherein the guided sleeve is rotatable more than one full revolution.

14. The downhole tool of claim 1, wherein the downhole tool comprises a reamer.

15. The downhole tool of claim 1, wherein the reciprocating sleeve and the guided sleeve are lubricated by a fluid flowing in the fluid path.

16. The downhole tool of claim 1, wherein the reciprocating sleeve and the guided sleeve are lubricated by a fluid separated from a fluid flowing in the fluid path.

17. The downhole tool of claim 1, wherein the tool comprises rolling bearings disposed between an outer diameter of the guided sleeve and the bore of the tubular body.

18. The downhole tool of claim 1, wherein the reciprocating sleeve is biased in a direction opposite the direction of a flow of fluid in the fluid path.

19. The downhole tool of claim 1, wherein the reciprocating sleeve is actuated by an obstruction.

20. The downhole tool of claim 1, wherein the guided sleeve comprises pins configured to position the guided sleeve with respect to the tubular body of the tool and shear upon actuation of the guided sleeve by a first obstruction.

* * * * *